US005143127A

United States Patent [19]

Rautio

[11] Patent Number: 5,143,127

[45] Date of Patent: Sep. 1, 1992

[54] SAWING MACHINE

[76] Inventor: Kauko Rautio, Kolmihaarantie 1, 52700 Mäntyharju, Finland

[21] Appl. No.: 601,692

[22] PCT Filed: Mar. 22, 1989

[86] PCT No.: PCT/FI89/00051

§ 371 Date: Oct. 25, 1990

§ 102(e) Date: Oct. 25, 1990

[87] PCT Pub. No.: WO89/10824

PCT Pub. Date: Nov. 16, 1989

[30] Foreign Application Priority Data

May 10, 1988 [FI] Finland ..... 882172

[51] Int. Cl.[5] ..... B27C 9/00

[52] U.S. Cl. ..... 144/39; 83/102.1; 144/41; 144/369; 144/378

[58] Field of Search ..... 144/37, 39, 41, 737, 144/367, 369, 373-375, 378; 83/102, 102.1, 508.3

[56] References Cited

U.S. PATENT DOCUMENTS

| | | | |
|---|---|---|---|
| 3,742,796 | 7/1973 | McMillan | 83/102.1 |
| 3,828,635 | 8/1974 | Smith | 83/102.1 |
| 3,903,771 | 9/1975 | Fritz et al. | 83/102.1 |
| 3,934,630 | 1/1976 | Cockle | 144/39 |
| 4,009,741 | 3/1977 | Zimmerman . | |
| 4,416,312 | 11/1983 | Ostberg | 83/102.1 |
| 4,485,861 | 12/1984 | Nilsson et al. | 144/39 |
| 4,548,247 | 10/1985 | Eklund | 144/39 |
| 4,561,477 | 12/1985 | Zimmerman . | |
| 4,572,256 | 2/1986 | Rautio | 144/39 |
| 4,599,929 | 7/1986 | Dutina | 144/39 |
| 4,691,749 | 9/1987 | Reuter | 144/39 |
| 4,711,279 | 12/1987 | Reuter . | |

FOREIGN PATENT DOCUMENTS

| | | |
|---|---|---|
| 0106907 | 10/1982 | European Pat. Off. . |
| 3416452 | 11/1985 | Fed. Rep. of Germany . |
| 3536983 | 4/1987 | Fed. Rep. of Germany . |
| 222746 | 9/1968 | Sweden . |

*Primary Examiner*—W. Donald Bray

[57] ABSTRACT

An apparatus for the cutting and sawing of logs including a cutting unit mounted to engage the log and including a pair of spaced apart axle sets. Each of said axle sets has mounted thereon at least one disc saw for sawing the logs in a lengthwise direction and at least one chipper edger for chipping a board to the right width. The cutting unit is moveable so that the axle sets are moved and the position of the disc saw and the chipper edger on each of the axle sets in changed relative to the log.

4 Claims, 4 Drawing Sheets

SAWING MACHINE

The present invention relates to a sawing machine for the sawing of boards or equivalent from logs, consisting of log feeding devices, cutter heads for chipping the log surface, and disc saw units for sawing the logs in the lengthwise direction, the sets of rotation axles of said disc saw units being located on opposite sides of the log, each of said units comprising at least one disc saw blade and one or more chipper edgers for chipping the board to the right width, in which units the disc saw blades and the chipper edgers, respectively, placed on opposite sides of the log are mutually aligned relative to the lateral direction of the log, the sawing machine being provided with divider blades, placed after the disc saw units, for separating the sawn boards or equivalent.

Figure 1:
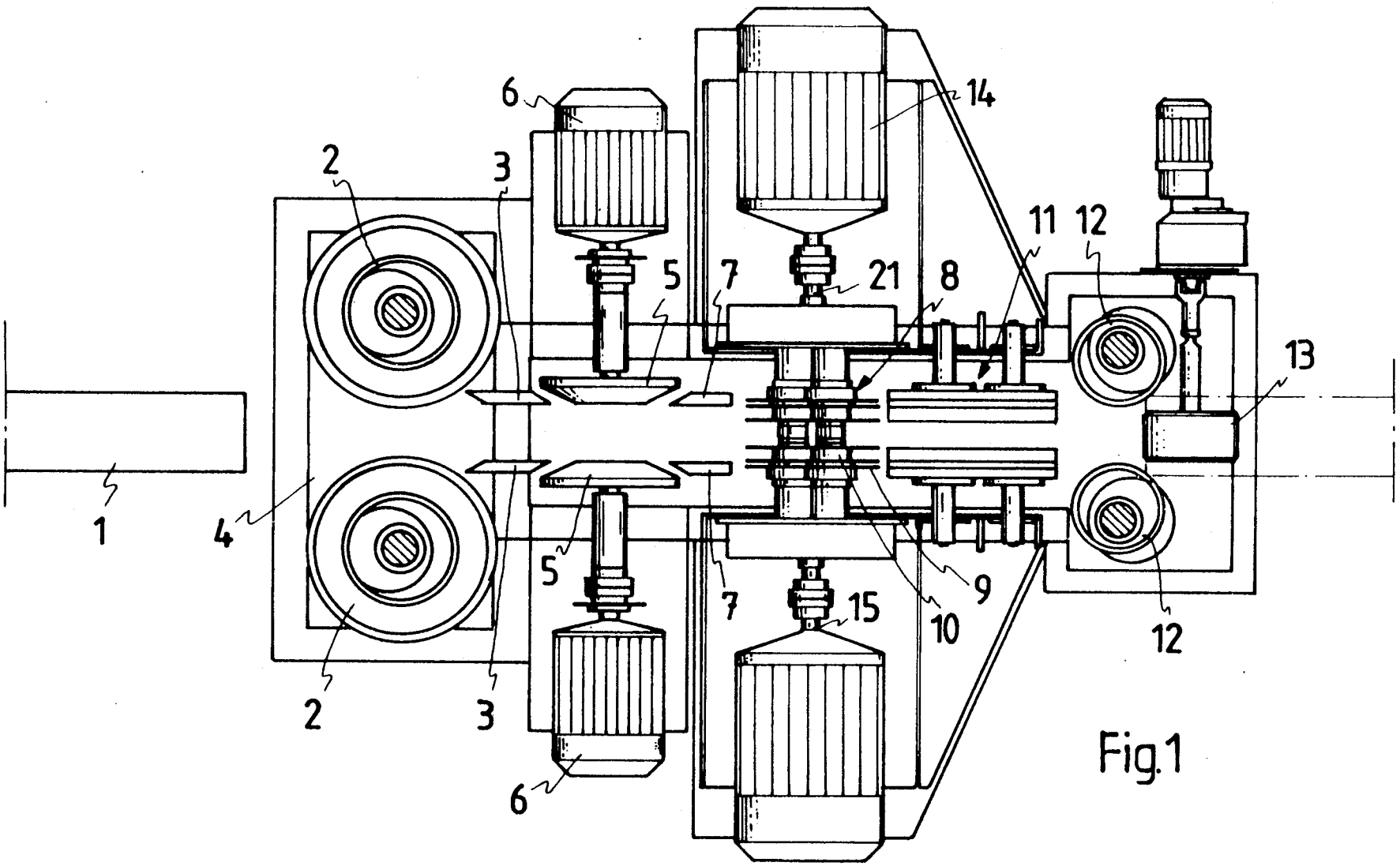

A sawing machine of this type is proposed in FI-patent application 824207. It comprises two disc saw units placed above and below the log to be sawn. The disc saw blades are large enough in diameter to allow them to cut as deep as halfway through the log, or rather somewhat deeper to ensure that the blades will make a complete cut. In FIG. 1 of said FI-patent application, the disc saw units seem to be placed at the same vertical plane, but in practice they must be staggered in the longitudinal direction of the log to avoid the blades hitting each other. The disc saw units also comprise chipper edgers for cutting the boards to the desired width. If the board width is to be altered, then the chipper edgers have to be replaced with new ones of the appropriate size. This is naturally time-consuming. Moreover, a large number of different-sized chipper edgers for different board widths need to be kept in store. A further drawback in the sawing machine proposed by FI-patent application 824207 is that each disc saw unit is driven by a separate motor (not shown in the drawing), which also adds to the cost.

The object of the present invention is to create a sawing machine that is free of the disadvantages referred to. The sawing machine of the invention is characterized in that the position of the axle sets of the disc saw units relative to the midline of the log to be sawn is adjustable.

A preferred embodiment of the sawing machine of the invention is characterized in that the divider blades - known in themselves - placed after the disc saw units are connected to at least one of the disc saw units in such manner that the position of the divider blades is altered depending on the position of the disc saw units.

Another preferred embodiment of the sawing machine of the invention is characterized in that the machine has two motors for driving the disc saw units, one motor on each side of the sawing line, and that the driving motors are coaxially arranged.

The invention provides several advantages over previously known techniques. The chief advantage is that, due to the adjustability of the disc saw units, there is no need to replace the chipper edgers when the board width is to be changed. In the embodiment presented by the figures, described below in greater detail, it is only necessary to adjust the disc saw units so as to turn the plane passing through their axles until the vertical distance between the chipper edgers of the upper and lower disc saw units becomes equal to the desired board width. In other words, the position of the axle sets of the disc saw units is adjusted relative to the midline of the log, so that the boards can be chipped to the desired width by the edgers. Using a branching gear between the driving motor and the disc saw units, only one motor is needed on each side of the sawing line, thus allowing the construction of the sawing machine to be simplified.

In the following, the invention is described by the aid of an example, reference being made to the drawing attached, wherein:

FIG. 1 presents the sawing machine of the invention in top view.

Figure 2:
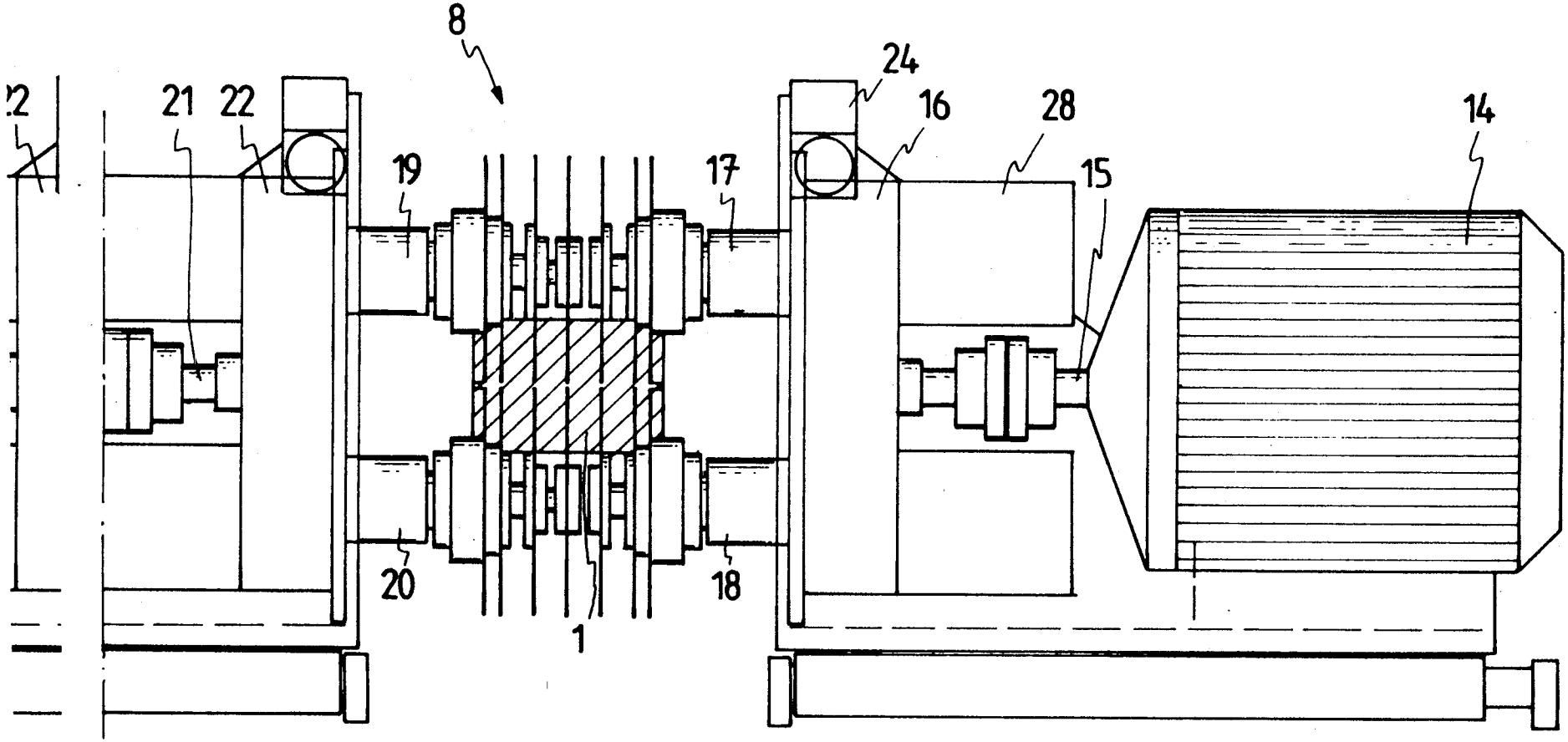

FIG. 2 presents the disc saw units of the sawing machine of the invention, seen from the direction in which the logs are sawn.

Figure 3:
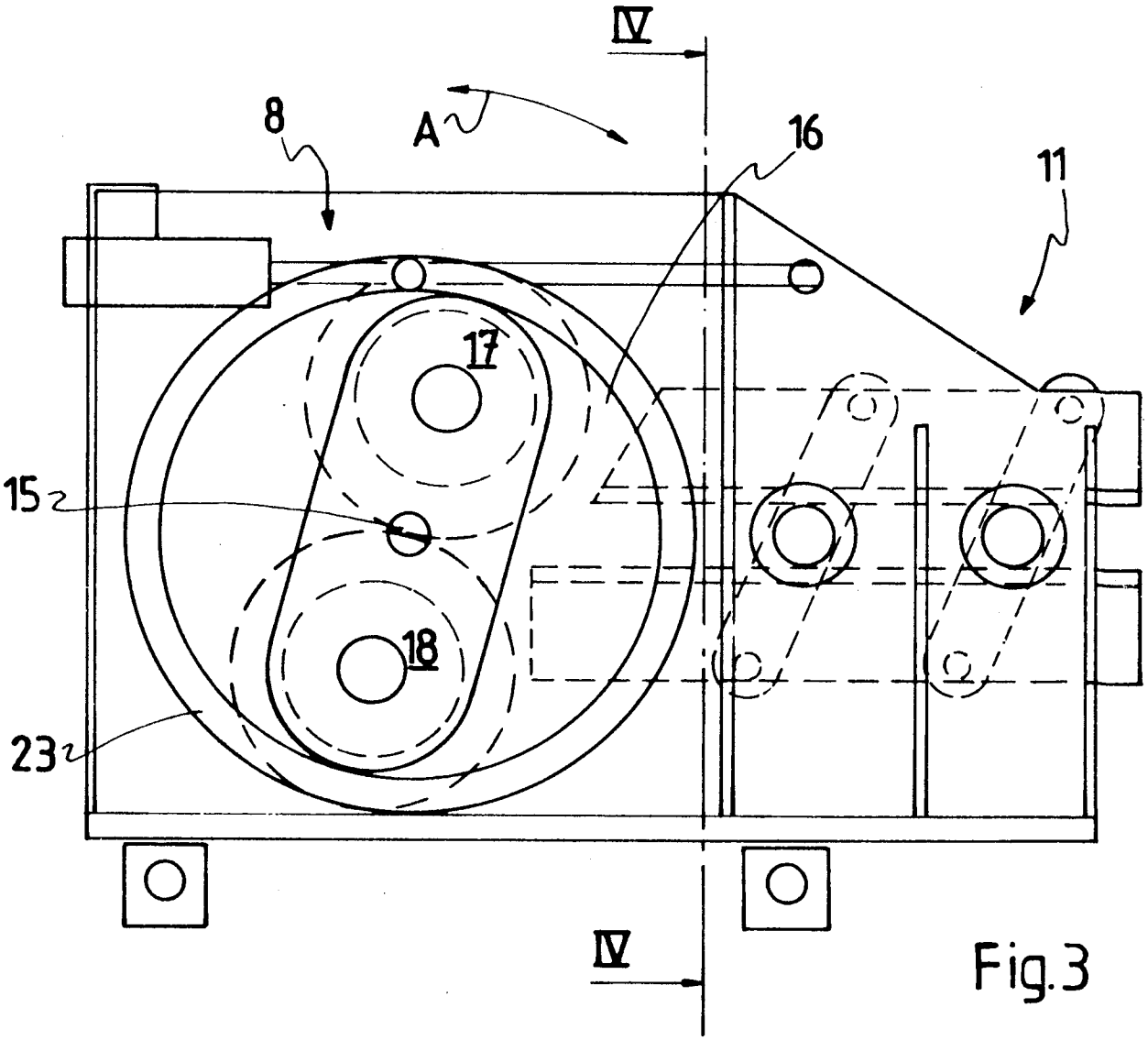

FIG. 3 shows a diagram of the disc saw units and the divider blades connected to them as seen from the side.

Figure 4:
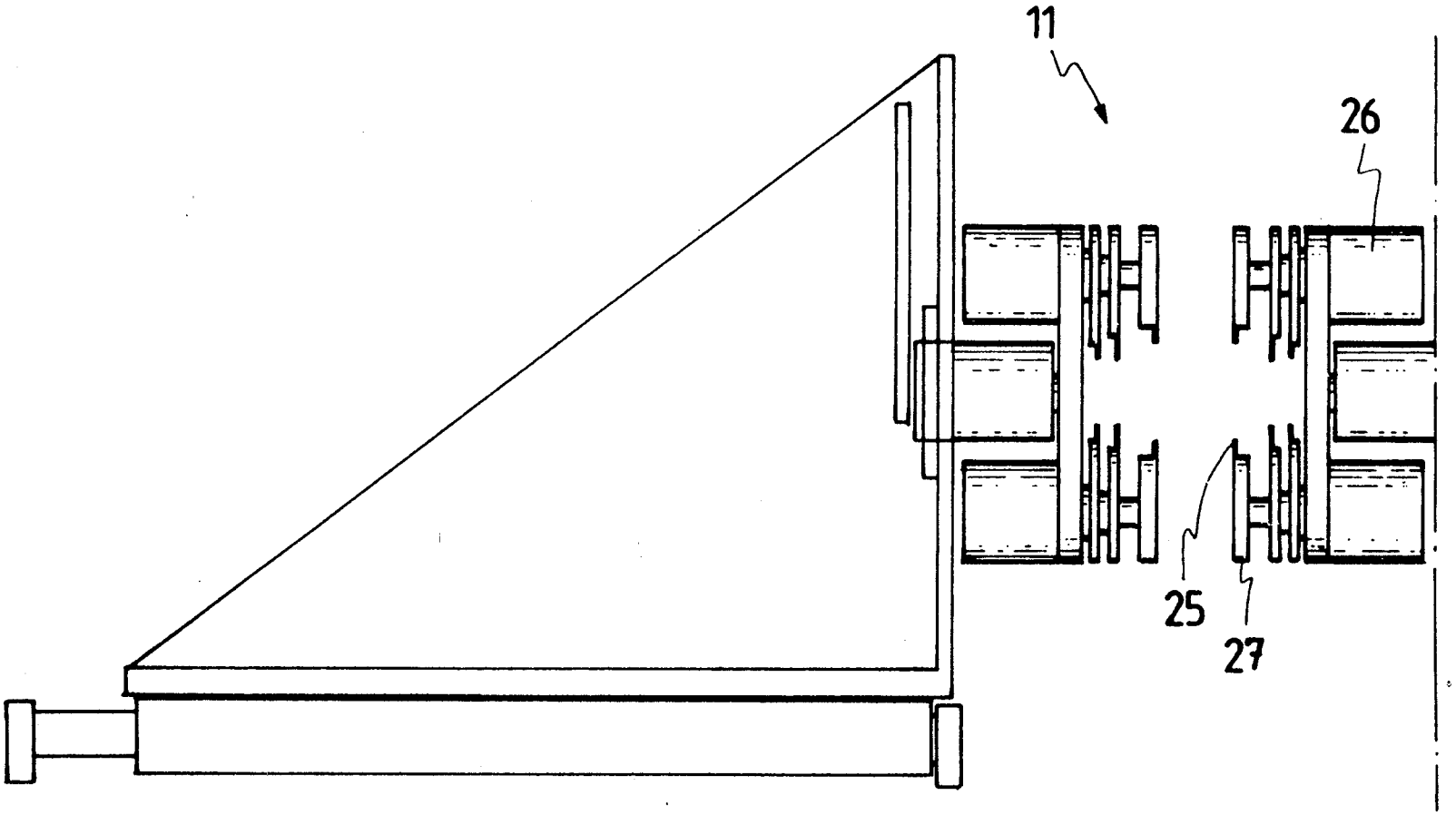

FIG. 4 presents the divider blade units as sectioned along the line IV—IV in FIG. 3.

FIG. 1 shows the main parts of the sawing machine of the invention. The logs 1 are fed into the machine from the left. The log is centered in the transverse direction and passed forwards by feed wheels 2 and guides 3. To ensure a better grip, the feed wheels 2 may be made of rubber and provided with gripping studs, as is generally known. The log is continuously supported from below by a slide rail 4.

First, the log is treated by chipper heads 5, which produce high-quality chips from the sides of the log, thereby making them flat and straight. The chipper heads are rotated by motors 6. Suitable chipping cutters are proposed e.g. in FI-patent application 802468. Guides 7 hold the log steady by pressing against the chipped surfaces. The guides are adjusted along with the chipper heads 5.

Next, the log proceeds into the disc saw unit 8, which consists of disc saw blades 9 placed above and below the log or oppositely on either side of it and chipper edgers 10 connected to them. A previously known disc saw unit of this kind is proposed in FI-patent application 824207. In the present embodiment, the disc saw blades 9 are mounted on four adjustable sets of axles. They saw the interior part of the log and saw and edge the sideboards. The sets of axles are rotated by motors 14. Next to the disc saw units 8 are divider blade units 11, which consist of divider blades that separate the sideboards and keep them steady. Finally, the sawn boards are extracted from the sawing machine by extractor wheels 12 and a conveyor 13.

FIG. 2 presents a more detailed view of the disc saw units 8. One of the two motors has been omitted from the figure, but it is arranged identically to the one shown, on the opposite side of the sawing line. As shown, there are seven disc saw blades both above and below the log 1. The chipper edgers 10, of which there are six above and as many below the log, are located between the discs. The motor 14, by means of its shaft 15, rotates a branching gear 16 which transmits the power to the axle sets 17 and 18, which consist of several concentric axles that can be adjusted separately e.g. by means of servo cylinders 28. In the same way, the motor on the other side rotates its shaft 15, which transmits the motion to a branching gear 22 and further to the axle sets 19 and 20.

FIG. 3 illustrates the disc saw units 8 and the divider blade units 11 connected to them. The figure manifests the main idea of the present invention. So far, it has been possible to move the upper and lower disc saw units in the lateral directions and to rotate them about their axis. The disc saw units 8 of the invention are so constructed that theY can be turned in the manner indicated by the arrow A. In other words, the upper 17 and lower 18 axle sets (as well as axle sets 19 and 20) can be moved closer to or farther away from the midline. The axle sets 17 and 18 are so turned that the plane passing through them always passes through the motor shaft 15. Thus, the vertical distance between the chipper edgers decreases or increases and the width of the board to be sawn is altered correspondingly.

Naturally, the disc saw units can be turned by any means imaginable, e.g. manually. An advantageous solution is to attach the axle sets tangentially to a bearing ring 23 which is in turn connected to a servo 24. The servo 24 turns the bearing ring and therefore the axle sets in the desired manner. Using a suitable lever mechanism, the bearing ring 23 is further connected to the divider blade unit 11, so that the divider blades are turned with the disc saw units. This ensures that the disc saw blades will never hit the divider blades.

FIG. 4 presents a more detailed view of the divider blade unit 11. As shown, the unit comprises a number of divider blades 25, preferably equalling the number of disc saw blades, and a servo motor or sevo cylinder 26 for the adjustment of the position of the divider blades. Reference number 27 indicates the part of the divider blade which keeps the board steady by pressing against the board surface treated by the chipper edger.

The number and size of the objects to be sawn from a log can be determined using an automatic positioning system. In such a system, automatic control takes care of centering the log in the transverse and vertical directions, adjusting the distance between the chipper heads by virtue of the turnable disc saw units, as well as the width of the sideboards and the vertical distance between the disc saw & edger units and the clearing between the disc saw blades. The operator supervises the operation of the automatic system via a terminal in the control panel. In a practical arrangement, a log measuring device supplies the control program with the log size data, whereupon the program displays the sizes and number of boards that, according to the instructions given in advance, would be sawn from a log of the size in question. The operator either confirms these specifications or enters new dimensions (and numbers) of the objects to be sawn. The sawing machine is automatically adjusted, which can be effected in a matter of half a second if necessary. Thus, it is possible to start feeding the machine with unsorted logs of a new order of size. If necessary, the width of the sideboards can be quickly adjusted separately for each log according to the size and curvature of the log.

It is obvious to a person skilled in the art that the invention is not restricted to the examples of its embodiments described above, but that it may instead be varied in the scope of the following claims.

I claim:

1. An apparatus for the cutting and sawing of logs, said apparatus comprising means for feeding logs, chipping cutter head means for chipping the log surface, a first cutting unit means mounted on one side of the log to engage the log, said cutting unit means including a pair of spaced apart axle sets, each of said axle sets having mounted thereon at least one disc saw for sawing the logs in a lengthwise direction and at least one chipper edge for chipping a board to the right width, means for moving said cutting unit means to said pair of spaced apart axle sets are moved and the position of said at least one disc saw and said at least one chipper edger on each of said axle sets is changed relative to the log, a second cutting unit means mounted on an opposite side of the log to engage the log, said second cutting unit means including a pair of spaced apart axle sets with each of said axle sets having mounted thereon at least one disc saw and at least one chipper edger, and means for moving said second cutting unit means so that said pair of spaced apart axle sets are moved and the position of said at least one disc saw and said at least one shipper edger is changed relative to the log.

2. Apparatus according to claim 1 wherein said axle sets of said first cutting unit means and said axle sets of said second cutting unit means are in alignment.

3. Apparatus according to claim 1 further including divider blade means located after each said cutting unit means for separating the sawn boards, and means connecting each said cutting unit means and its respective said divider blade means in such a manner that the position of the divider blade means is altered depending on the position of said cutting unit means.

4. Apparatus according to claim 1 wherein said first cutting unit means and said second cutting unit means are each powered by a motor, with the motors being coaxially arranged.

* * * * *